US011085010B2

(12) United States Patent
Hu et al.

(10) Patent No.: US 11,085,010 B2
(45) Date of Patent: Aug. 10, 2021

(54) METHOD FOR OFF-LINE CLEANING OF COOLING TOWERS

(71) Applicant: ECOLAB USA, Inc., St. Paul, MN (US)

(72) Inventors: Lanhua Hu, Woodridge, IL (US); Amit Gupta, Aurora, IL (US)

(73) Assignee: ECOLAB USA INC., St. Paul, MN (US)

( * ) Notice: Subject to any disclaimer, the term of this patent is extended or adjusted under 35 U.S.C. 154(b) by 106 days.

(21) Appl. No.: 16/103,347

(22) Filed: Aug. 14, 2018

(65) Prior Publication Data

US 2019/0055502 A1 Feb. 21, 2019

Related U.S. Application Data

(60) Provisional application No. 62/547,516, filed on Aug. 18, 2017.

(51) Int. Cl.

| | |
|---|---|
| ***C11D 1/29*** | (2006.01) |
| ***C11D 1/66*** | (2006.01) |
| ***C11D 1/75*** | (2006.01) |
| ***C11D 3/395*** | (2006.01) |
| ***C11D 11/00*** | (2006.01) |
| ***C11D 3/39*** | (2006.01) |
| ***C11D 3/20*** | (2006.01) |
| ***C11D 3/04*** | (2006.01) |
| ***C11D 1/825*** | (2006.01) |
| ***C11D 3/22*** | (2006.01) |

(52) U.S. Cl.

CPC ..... *C11D 11/0041* (2013.01); *C11D 1/8255* (2013.01); *C11D 3/042* (2013.01); *C11D 3/2082* (2013.01); *C11D 3/2086* (2013.01); *C11D 3/22* (2013.01); *C11D 3/3902* (2013.01); *C11D 3/3942* (2013.01); *C11D 3/3947* (2013.01); *C11D 3/3951* (2013.01); *C11D 3/3953* (2013.01); *C11D 3/3956* (2013.01); *C11D 1/662* (2013.01)

(58) Field of Classification Search

CPC ..... C11D 1/662; C11D 3/042; C11D 3/22; C11D 3/3902; C11D 3/3942; C11D 3/3947; C11D 3/3951; C11D 3/3953; C11D 3/3956

USPC ..... 510/234, 372, 379, 380, 470, 477, 488, 510/492

See application file for complete search history.

(56) References Cited

U.S. PATENT DOCUMENTS

| | | | | |
|---|---|---|---|---|
| 5,401,311 | A * | 3/1995 | Freese | C02F 5/14 134/2 |
| 5,736,097 | A | 4/1998 | Ono | |
| 5,800,732 | A | 9/1998 | Coughlin et al. | |
| 6,007,726 | A | 12/1999 | Yang et al. | |
| 6,080,323 | A | 6/2000 | Yu et al. | |
| 6,596,677 | B1 * | 7/2003 | Machac, Jr. | C11D 3/3947 134/40 |
| 7,662,289 | B2 | 2/2010 | Musale et al. | |
| 8,668,779 | B2 | 3/2014 | Cooper et al. | |
| 9,404,069 | B1 * | 8/2016 | Kane | C11D 17/003 |
| 10,099,264 | B2 * | 10/2018 | Fernholz | C11D 3/3956 |
| 2006/0100122 | A1 * | 5/2006 | Baars | C11D 17/041 510/375 |
| 2008/0139443 | A1 * | 6/2008 | Buzinski | C11D 1/835 510/362 |
| 2008/0152567 | A1 | 6/2008 | Killough | |
| 2008/0271758 | A1 | 11/2008 | Musale | |
| 2009/0065440 | A1 | 3/2009 | Hicks et al. | |
| 2010/0229953 | A1 * | 9/2010 | Stuart | F28G 9/00 137/1 |
| 2010/0294307 | A1 * | 11/2010 | Tyborski | C11D 1/83 134/3 |
| 2010/0317559 | A1 | 12/2010 | Ryther et al. | |
| 2013/0196890 | A1 * | 8/2013 | Post | C11D 3/48 510/363 |
| 2013/0203644 | A1 * | 8/2013 | Lant | C11D 3/3947 510/305 |
| 2014/0041686 | A1 | 2/2014 | Ryther et al. | |

(Continued)

FOREIGN PATENT DOCUMENTS

| | | |
|---|---|---|
| CN | 103449616 A | 12/2013 |
| CN | 104628155 A | 5/2015 |
| IN | 272435 | 3/2016 |
| JP | S 5697598 A | 8/1981 |
| JP | S 63289100 A | 11/1988 |

OTHER PUBLICATIONS

Earth Science, Introduction to Clay Minerals & Soils, p. 1-3, 2000. (Year: 2000).*

(Continued)

*Primary Examiner* — Gregory R Delcotto

(74) *Attorney, Agent, or Firm* — Eric D. Babych; Barnes & Thornburg LLP

(57) ABSTRACT

A method of cleaning a cooling water system is disclosed. The method may include contacting a cooling tower fill with a composition that may include a surfactant and an additive selected from an oxidizing agent, an acid, and any combination thereof when the cooling water system is off-line. The method may include contacting a deposit in the cooling tower fill with the composition. The oxidizing agent may be hydrogen peroxide, sodium hypochlorite, chlorine dioxide, ozone, sodium hypobromite, sodium or potassium permanganate, or any combination thereof. The surfactant may include a $C_8$-$C_{10}$ alkyl polyglycoside and a $C_{10}$-$C_{18}$ alkyl polyglycoside.

18 Claims, No Drawings

(56) References Cited

U.S. PATENT DOCUMENTS

| | | | | |
|---|---|---|---|---|
| 2015/0183673 | A1 | 7/2015 | Musale et al. | |
| 2015/0315517 | A1* | 11/2015 | Man | C11D 1/83 510/283 |
| 2016/0176814 | A1 | 6/2016 | Balasubramanian et al. | |
| 2016/0348251 | A1 | 12/2016 | Seetharaman et al. | |
| 2016/0362636 | A1* | 12/2016 | Kane | C11D 11/0041 |
| 2017/0028449 | A1 | 2/2017 | Fernholz et al. | |
| 2017/0128605 | A1 | 5/2017 | Franciskovich et al. | |
| 2017/0137634 | A1 | 5/2017 | Balasubramanian et al. | |
| 2018/0208879 | A1* | 7/2018 | Man | C11D 1/83 |

OTHER PUBLICATIONS

Science Learning Hub, What is Clay?, p. 1-7, Apr. 27, 2010. (Year: 2010).*

Alvarez, Dan, E. Heinlein, R. J. Holmes, B. Arya, L. Shon-Roy, and J. Spiegelman. "New Vaporization Sources for H2O2 for Pretreatment/Cleaning of ALD Deposition Surfaces," 2013 24th Annual SEMI Advanced Semiconductor Manufacturing Conference, Saratoga Springs, NY, Accession No. 1364-1524 (2013), 4 pages.

Nishimura, K., T. Yasunaga, S. Ichikawa, and Y. Wakao. "Development of a new antifouling method for a marine cooling water system," Marine Biology, 99, 145-150 (1988). Berlin, Heidelberg, Accession No. 2001-63-031862 (CE).

Pearrow, John J. and D. Daniels. "Hydrogen peroxide keeps cooling tower fill clean," Power, 145(3), (May/Jun. 2001), 5 pages.

Sinha, Ashwini. "Fouling Control of PVC Film-Type Cooling Tower Fills at Power Plants," Materials Performance, 47(2), 50-54 (2008). ISSN: 00941492, National Association of Corrosion Engineers International, Accession No. 20080811111704 (2008).

USP Technologies, Case Study, "Cooling Tower Cleaning." Atlanta, Georgia (2015), 2 pages.

Vance, Fredrick W., J. Ekman, and M. Hesampour. "New Solution for Controlling of Organic and Biofouling in High Pressure Membrane Applications," AMTA/AWWA Membrane Technology Conference and Exposition 2013, American Water Works Association, Accession No. 20135117111718 (2013), 29 pages.

* cited by examiner

METHOD FOR OFF-LINE CLEANING OF COOLING TOWERS

BACKGROUND

1. Field of the Invention

The present disclosure generally relates to cooling towers. More particularly, the disclosure pertains to compositions and methods of cleaning cooling towers.

2. Description of the Related Art

Cooling towers rely on evaporation to remove heat from a stream of water (or other medium). Cooling towers may have a cross-flow design with the flow of ambient air and flow of water. Other cooling tower designs include counter-current flow types. In open cooling towers, the water to be cooled is exposed directly to the atmosphere. Typically, the warm water is sprayed over the top of a "fill" portion in the cooling tower while ambient air is blown through the fill. The fill is used to increase the contact area between the warm water and the (cooling) air, thereby providing greater heat transfer.

A supply of hot water enters the cooling tower through water inlets. The water is distributed over the fill by distribution plates or nozzles. Other means for distributing the water, such as a spray header, are also common. The water falls down through the fill, where it is cooled through the flow of air. The cooled water collects in a basin below the fill and exits the cooling tower through a water outlet. A fan helps drive the flow of air through the fill.

One problem associated with cooling towers is the build-up of scale deposits on the fill. Minerals dissolved in the cooling water accumulate on the fill as the water evaporates. Buildup or fouling can significantly reduce the heat transfer and, therefore, reduce the efficiency of the cooling tower. Further, excessive fouling can even cause the fill portion to collapse due to the additional weight of the fouling material. It is therefore desirable to remove fouling or buildup that occurs on the fill.

Cooling water systems are prone to fouling due to the deposition of inorganic and organic contaminants. Recirculating cooling water systems are particularly of concern since there is a constant influx of contaminants as a function of the cooling process where heat is transferred from the water to the air. The deposits that occur in the cooling water system, such as those in the cooling tower, associated pipes and the cooling tower fill may require different treatment processes for cleaning depending on the chemical nature of the foulant.

BRIEF SUMMARY

In some embodiments, a method of cleaning a cooling water system is disclosed. The method may include contacting a cooling tower fill with a composition that may include a surfactant and an additive selected from an oxidizing agent, an acid, and any combination thereof when the cooling water system is off-line.

In some embodiments, the method may include contacting a deposit in the cooling tower fill with the composition.

In some embodiments, the oxidizing agent may be selected from hydrogen peroxide, sodium hypochlorite, chlorine dioxide, ozone, sodium hypobromite, sodium or potassium permanganate, potassium peroxymono sulfate, peroxy salts of alkali earth metals, and any combination thereof.

In some embodiments, the oxidizing agent may include hydrogen peroxide and a concentration of the hydrogen peroxide in the composition may be about 0.25% to about 50% by weight.

In some embodiments, the oxidizing agent may include hydrogen peroxide and a concentration of the hydrogen peroxide in the composition is about 7% to about 40% by weight.

In some embodiments, the acid may be selected from hydrochloric acid, sulfuric acid, sulfamic acid, oxalic acid, citric acid, and any combination thereof.

In some embodiments, the surfactant may be non-ionic, ionic, or zwitterionic

In some embodiments, the surfactant may include a $C_6$-$C_{18}$ alkyl polyglycoside.

In some embodiments, the surfactant may include a $C_8$-$C_{10}$ alkyl polyglycoside and a $C_{10}$-$C_{18}$ alkyl polyglycoside.

In some embodiments, a mass ratio of hydrogen peroxide to surfactant ranges from about 200:1 to about 10:1.

In some embodiments, the composition may have a pH of about 0 to about 7.

In some embodiments, the composition may contact the cooling tower fill for about 1 minute to about 48 hours.

In other embodiments, a method of cleaning cooling water systems is disclosed. The method may include contacting a deposit with a composition comprising about 0.25% to about 50% by weight of hydrogen peroxide, and contacting the deposit with a surfactant.

In some embodiments, the composition may include about 7% to about 50% by weight of hydrogen peroxide.

In some embodiments, the composition may include about 30% to about 40% by weight of hydrogen peroxide.

In some embodiments, the deposit may include silica.

In some embodiments, the deposit may include silt.

In some embodiments, the composition may contact the deposit for about 1 minute to about 48 hours.

In other embodiments, a use of a composition including hydrogen peroxide and a surfactant for cleaning cooling tower fill is disclosed.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

DETAILED DESCRIPTION

Various embodiments are described below. The relationship and functioning of the various elements of the embodiments may better be understood by reference to the following detailed description. However, embodiments are not limited to those illustrated below. In certain instances details may have been omitted that are not necessary for an understanding of embodiments disclosed herein.

In some embodiments, a method of cleaning a cooling water system is disclosed. The method may include contacting a cooling tower fill with a composition that may include a surfactant and an additive selected from an oxidizing agent, an acid, and any combination thereof when the cooling water system is off-line. The compositions and methods of the present disclosure can remove deposits or fouling from a surface and promote dispersion of the removed deposits.

As used herein "off-line" refers to a state of an industrial process unit in which the process unit is disconnected physically or functionally from a process. For example, a cooling tower would be considered off-line for the period of time that water is not being circulated for cooling purposes.

In some embodiments, the cooling water system may be a cooling tower. "Cooling Tower" refers heat removal devices used to transfer process waste heat to the atmosphere. Cooling towers commonly use evaporation of water to remove process heat and cool the working fluid to near the wet-bulb air temperature. Cooling towers includes both evaporative cooling tower and evaporative condensers.

"Recirculating Heat Exchanger" refers to one or more pieces of equipment and/or a system, constructed and arranged to facilitate heating or cooling heat transfer to or from a fluid circulating or recirculating through the equipment/system, for purposes of this application the vernacular term "cooling tower" will encompass all forms of Recirculating Heat Exchangers.

In some embodiments, the method may include contacting a deposit in the cooling tower fill with the composition. As used herein "deposit" refers to, unless otherwise specified, any unwanted material that has accumulated on a surface of the cooling water system. The compositions of the present disclosure may be effective against deposits that are resistant to treatment with stabilized halogenated oxidants.

In other embodiments, the composition may contact other surfaces of a cooling water system besides cooling tower fill. The composition may contact the inside of tanks, pipes, or spray nozzles of a cooling water system.

In some embodiments, the oxidizing agent may be hydrogen peroxide, sodium hypochlorite, chlorine dioxide, ozone, sodium hypobromite, sodium or potassium permanganate, potassium peroxymono sulfate, peroxy salts of alkali earth metals, and any combination thereof. In some embodiments, the oxidizing agent may be selected from hydrogen peroxide, sodium hypochlorite, chlorine dioxide, or any combination thereof. In some embodiments, the oxidizing agent may be hydrogen peroxide.

In some embodiments, the oxidizing agent, such as hydrogen peroxide may be in a non-stabilized form and/or may exclude a stabilizing agent. Non-limiting examples of stabilizing agents include, but are not limited to, sodium stannate, sodium pyrophosphate, organophosphonates, nitrate, or colloidal silicate.

In some embodiments, the oxidizing agent may include hydrogen peroxide and a concentration of the hydrogen peroxide in the composition may be about 0.25% to about 50% by weight. In some embodiments, the oxidizing agent may include hydrogen peroxide and a concentration of the hydrogen peroxide in the composition is about 7% to about 40% by weight, about 10% to about 40% by weight, about 15% to about 40% by weight, about 20% to about 40% by weight, about 25% to about 40% by weight, about 30% to about 40% by weight, or about 30% to about 50% by weight. In some embodiments, the concentration of the hydrogen peroxide in the composition may be about 35% by weight.

In some embodiments, the acid may be hydrochloric acid, sulfuric acid, sulfamic acid, oxalic acid, citric acid, or any combination thereof. In some embodiments, the acid may be hydrochloric acid. The concentration of the acid in the composition may be from about 0.2 M to about 2 M, about 0.3 M to about 2 M, about 0.4 M to about 2 M, about 0.5 M to about 2 M, about 0.6 M to about 2 M, about 0.7 M to about 2 M, about 0.8 M to about 2 M, about 0.9 M to about 2 M, about 1.0 M to about 2 M, about 0.8 M to about 1.5 M, about 0.8 M to about 1.2 M, or about 0.9 M to about 1.1 M. In some embodiments, the concentration of the acid in the composition may be about 1 M.

In some embodiments, the surfactant may be non-ionic, ionic, or zwitterionic. Suitable surfactants include, but are not limited to, anionic surfactants, cationic surfactants, non-ionic surfactants, and combinations thereof. Anionic surfactants include alkyl aryl sulfonates, olefin sulfonates, paraffin sulfonates, alcohol sulfates, alcohol ether sulfates, alkyl carboxylates and alkyl ether carboxylates, and alkyl and ethoxylated alkyl phosphate esters, and mono and dialkyl sulfosuccinates and sulfosuccinamates, and combinations thereof. Cationic surfactants include alkyl trimethyl quaternary ammonium salts, alkyl dimethyl benzyl quaternary ammonium salts, dialkyl dimethyl quaternary ammonium salts, imidazolinium salts, and combinations thereof. Non-ionic surfactants include alcohol alkoxylates, alkylphenol alkoxylates, block copolymers of ethylene, propylene and butylene oxides, alkyl dimethyl amine oxides, alkyl-bis(2-hydroxyethyl) amine oxides, alkyl amidopropyl dimethyl amine oxides, alkylamidopropyl-bis(2-hydroxyethyl) amine oxides, alkyl polyglucosides, polyalkoxylated glycerides, sorbitan esters and polyalkoxylated sorbitan esters, and alkoyl polyethylene glycol esters and diesters, and combinations thereof. Also included are betaines and sultanes, amphoteric surfactants such as alkyl amphoacetates and amphodiacetates, alkyl amphopropripionates and amphodipropionates, alkyliminodiproprionate, and combinations thereof.

In some embodiments, the surfactant may be non-ionic. In some embodiments, the surfactant may include a $C_6$-$C_{18}$ alkyl polyglycoside. In some embodiments, the surfactant may include a $C_8$-$C_{10}$ alkyl polyglycoside and a $C_{10}$-$C_{18}$ alkyl polyglycoside. As used herein "alkyl polyglycoside" refers to non-ionic surfactants having an alkyl chain and a polymer of a sugar molecule. Alkyl polyglycosides are commercially available and can be produced by reaction between a sugar and fatty alcohol over an acid catalyst.

In some embodiments, a mass ratio of hydrogen peroxide to surfactant ranges from about 200:1 to about 10:1. In some embodiments, the mass ratio of hydrogen peroxide to surfactant may be from about 150:1 to about 10:1, about 125:1 to about 10:1, about 100:1 to about 10:1, about 90:1 to about 10:1, about 80:1 to about 10:1, about 70:1 to about 10:1, about 150:1 to about 30:1, about 150:1 to about 40:1, or about 150:1 to about 60:1.

In other embodiments, the composition may consist of or consist essentially of a surfactant, an oxidizing agent, and water.

In some embodiments, the composition may have a pH of about 0 to about 7. In some embodiments, the composition may have a pH of about 0 to about 7, about 0 to about 6, about 0 to about 5, about 0.25 to about 6, about 0.25 to about 5.5, about 0.25 to about 5, about 0.25 to about 4.5, about 0.25 to about 4, about 0.25 to about 3.5, about 0.25 to about 3, about 0.25 to about 2.5, about 0.25 to about 2, about 0.25 to about 1.5, about 0.25 to about 1, about 2 to about 4, about 2.5 to about 3.5, about 3 to about 4.5, about 3.5 to about 4.5, about 1 to about 5, about 1 to about 4, or about 1 to about 3.

In other embodiments, a method of cleaning cooling water systems is disclosed. The method may include contacting a deposit with a composition comprising about 0.25% to about 50% by weight of hydrogen peroxide, and contacting the deposit with a surfactant.

In some embodiments, the deposit may include silica. In some embodiments, the deposit may include silt.

In some embodiments, the composition may include about 7% to about 50% by weight of hydrogen peroxide. In some embodiments, the composition may include about 30% to about 40% by weight of hydrogen peroxide.

In some embodiments, the composition may contact the cooling tower fill or deposit for about 1 minute to about 48 hours. In some embodiments, the composition may contact the deposit for about 1 minute to about 60 minutes, about 1 minute to about 40 min, about 1 minute to about 30 minutes, about 1 minute to about 25 minutes, about 1 minute to about 20 minutes, about 1 minute to about 15 minutes, about 1 minute to about 10 minutes, about 2 minutes to about 8 minutes, about 5 minutes to about 50 minutes, about 5 minutes to about 40 minutes, about 5 minutes to about 30 minutes, about 5 minutes to about 20 minutes, or about 10 minutes to about 20 minutes. In some embodiments, the composition may contact the deposit for about 5 minutes. In some embodiments, the composition may contact the deposit for about 15 minutes.

In some embodiments, the surfactant, acid, and oxidizing agent may contact a surface or any deposits on a surface of a cooling water system simultaneously. In other embodiments, the surfactant, acid, and oxidizing agent may contact a surface or any deposits on a surface of a cooling water system consecutively in any order. In certain embodiments, the surfactant and the oxidizing agent contact the surface or deposit on a surface of the cooling water system followed by contacting the surface or deposit with an acid. For example, a mixture of surfactant and oxidizing agent, such as hydrogen peroxide may be prepared before adding the mixture to the cooling tower fill. In another example, a mixture of oxidizing agent may be added to the cooling tower fill first followed by addition of an acid.

In some embodiments, the method may include contacting the cooling tower fill with an oxidizing agent, and contacting the cooling tower fill with an acid after contacting the cooling tower fill with the oxidizing agent.

In other embodiments, the method may include contacting the cooling tower fill with an oxidizing agent, and contacting the cooling tower fill with a surfactant after contacting the cooling tower fill with the oxidizing agent.

In some embodiments, the compositions of the present disclosure may exclude formic acid.

The compositions of the present disclosure can be utilized for cleaning or removing inorganic and/or organic deposits from any surface that experiences hardy deposits, particularly due to a wet/dry cycle of operation. These compositions would also be an effective hard surface sanitizer and a good cleaning program in the food and beverage industry. Also, with growing concerns around exposure to pathogens from cooling water systems, the compositions and methods disclosed herein could be used for periodic cleaning cooling water systems to prevent Legionella growth. Also, on-line clean-in-place applications could benefit from the compositions and methods of this disclosure.

EXAMPLES

Attempts were made previously to clean the deposits using a combination of a non-ionic surfactant and a stabilized halogenated oxidant. However, very little cleaning was observed by visual inspection and turbidity measurements showed no dispersion of the deposits following application of the non-ionic surfactant. An alternate oxidant (Towerbrom®, a halogenated isocyanurate that generates bromine) was applied at a higher dose of the non-ionic surfactant. The Towerbrom® chemistry was applied with the intent of replacing the stabilized chemistry with a non-stabilized form to get a higher oxidant impact. With this attempt, a significant increase in turbidity (up to about 20 NTU) and a significant level of free oxidant (about 3 ppm) was observed, but this did not significantly impact the deposit on the fill.

Cooling tower fill was obtained from a cooling water plant that operated intermittently and was experiencing significant fouling/deposition on the fill surface. To evaluate and identify the appropriate program, a section of the fouled cooling tower fill was obtained along with a sample of the cooling water. Analysis of the deposit suggested a high amount of silica in the form of silt and some organic deposits. The deposit from the fill exhibited a high level of silica (about 45 to about 50 wt %), and only about 20% material was lost at about 925° C.

The fill pack was received in a dry state. The deposit on the fill surface was brown in color. Following wetting with water, the deposits could be easily scrubbed off by gloved fingers. Not much effort was needed. The feel of the deposit was not slimy and had a "mud-like" feel which would relate well with the deposit analysis results and also the fact that the tower had undergone two previous cleaning attempts with a non-ionic dispersant and a stabilized oxidant.

Small coupons were cut from the tower fill to test with different chemistries. The size of the coupon was less than about one square inch. Several different chemistries and conditions were attempted to identify effective programs. To identify chemistries and conditions that showed some level of performance, initial measurement was made by visual inspection and physical removal of the deposit from the surface into the treatment solution.

For a more in-depth analysis, the dry weight of the coupon was recorded before and after treatment and following full removal of the deposit to establish the cleaning efficiency as a percentage of the deposit present. The pH of the treatment solution was also recorded. In addition varying the chemistry, contact time and method of application were varied to identify the most suitable method for effective deposit removal.

Several different chemistries were tested. A small coupon of the fouled fill was immersed in a solution of the chemistry and gently mixed by hand rotating the tube. Table 1 shows the different chemistries tested and their efficacy for removal of deposits by visual observation.

TABLE 1

Unsuccessful cleaning programs

| Chemistry | Contact Time | pH | Observation |
|---|---|---|---|
| 5% caustic by weight in water | Overnight | 13 | Very slight removal |
| Saturated solution of ethylenediaminetetraacetic acid (EDTA) | 10 min | 6.5 | Very slight removal |
| Hydroxyethylidene diphosphonic acid + copolymer of acrylic acid and 2-acrylamido-2-methylpropane sulfonic acid + $Na_2S0_3$ + EDTA | 10 min & overnight | 3.5 | Very slight removal |

Further attempts were made with other chemistries. Table 2 shows results for a variety of chemistries and conditions. Contact time refers to direct pipetting of chemistry onto the coupon and soaking.

TABLE 2

Deposit removal results for various chemistries and conditions

| Chemistry | Contact Time | pH | Observation |
|---|---|---|---|
| 500 ppm $H_2O_2$ | 15 min | 5.5-6.0 | No effect |
| 1000 ppm $H_2O_2$ | 15 min | 5.5-6.0 | No effect |
| 5000 ppm $H_2O_2$ | 15 min | 5.5-6.0 | Very slight removal |
| 10000 ppm $H_2O_2$ | 15 min | 5.5-6.0 | Slight removal |
| Water adj with Acid | Overnight | 3 | Slight removal |
| Water adj with Caustic | Overnight | 12.5 | Slight removal |
| $ClO_2$ (1500 ppm) | 5 min | 2 | Slight removal |
| Peracetic Acid (5 wt %) | 5 min | 1 | Some removal |
| 1M HCl | 5 min | 0.5 | Very good removal |
| 1M sulfuric acid | 5 min | 0.5 | Very good removal |
| 35 wt % $H_2O_2$ | 5 min | 2.5-3 | Very good removal |
| 35 wt % $H_2O_2$ and 0.5 wt % of $C_8$-$C_{10}$ alkyl polyglycoside and $C_{10}$-$C_{18}$ alkyl polyglycoside | 5 min | 4.5-5 | Very good removal |
| 1M HCl and 17.5 wt % $H_2O_2$ | 5 min | 1-1.5 | Very good removal |
| 1M HCl and 8.75 wt % $H_2O_2$ | 5 min | 1-1.5 | Good removal |
| 1M HCl and 5.25 wt % $H_2O_2$ | 5 min | 1-1.5 | Some removal |
| 1M HCl then 35 wt % $H_2O_2$ | 5 min | 1-1.5 | Some removal |
| 35 wt % $H_2O_2$ then 1M HCl | 5 min | 1-1.5 | Good removal |

Table 3 shows the percentage of deposit removal from cooling tower fill using acid and different concentrations of hydrogen peroxide. Over 70% of the deposit was removed after about 15 minutes of contact time with a solution of about 35 wt % hydrogen peroxide.

TABLE 3

Coupon soaking into treatment solution

| Chemistry | Contact Time | pH | % Deposit Removal |
|---|---|---|---|
| 1M HCl | 15 min | 0.5 | 27.2 |
| 35 wt % $H_2O_2$ | 15 min | 2.0 | 71.84 |
| 1M HCl and 17.5 wt % $H_2O_2$ | 15 min | 1 | 61.68 |
| 1M HCl and 8.75 wt % $H_2O_2$ | 15 min | 1 | 42.06 |
| 8.75 wt % $H_2O_2$ | 15 min | 4-4.5 | 64.86 |
| 6.5 wt % $H_2O_2$ | 15 min | 4.5 | 56.44 |
| 5.25 wt % $H_2O_2$ | 15 min | 4.5 | 37.7 |
| 2.2 wt % $H_2O_2$ | 15 min | 4.5 | 31.01 |
| 3.2 wt % $H_2O_2$ and 0.5 wt % of $C_8$-$C_{10}$ alkyl polyglycoside and $C_{10}$-$C_{18}$ alkyl polyglycoside | 15 min | 5 | 39.53 |
| 1M HCl | overnight | 0.5 | 70.4 |

It should be noted that the treatment solution containing about 35 wt % $H_2O_2$ and about 0.5 wt % of polyglycoside showed a significant amount of the removed deposit suspended in solution rather than settling out.

Any composition disclosed herein may comprise, consist of, or consist essentially of any of the compounds/components disclosed herein. In accordance with the present disclosure, the phrases "consist essentially of," "consists essentially of," "consisting essentially of," and the like limit the scope of a claim to the specified materials or steps and those materials or steps that do not materially affect the basic and novel characteristic(s) of the claimed invention.

As used herein, the term "about" refers to the cited value being within the errors arising from the standard deviation found in their respective testing measurements, and if those errors cannot be determined, then "about" refers to within 10% of the cited value.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a surfactant" is intended to include "at least one surfactant" or "one or more surfactants."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of cleaning a cooling water system, comprising:

contacting a cooling tower fill with a composition consisting of a surfactant, an oxidizing agent, water, and optionally, an acid, when the cooling water system is off-line, wherein:

the oxidizing agent is selected from hydrogen peroxide, sodium hypochlorite, chlorine dioxide, ozone, sodium hypobromite, sodium or potassium permanganate, potassium peroxymono sulfate, peroxy salts of alkali earth metals, or any combination thereof;

the acid is selected from hydrochloric acid, sulfuric acid, sulfamic acid, or any combination thereof; and a concentration of the oxidizing agent in the composition is about 0.50% to about 50% by weight.

2. The method of claim 1, wherein the oxidizing agent is hydrogen peroxide.

3. The method of claim 1, wherein the oxidizing agent is hydrogen peroxide and a concentration of the hydrogen peroxide in the composition is about 7% to about 40% by weight.

4. The method of claim 1, wherein the surfactant is non-ionic, ionic, or zwitterionic.

5. The method of claim 1, wherein the surfactant is a $C_8$-$C_{10}$ alkyl polyglycoside and a $C_{10}$-$C_{18}$ alkyl polyglycoside.

6. The method of claim 1, wherein a mass ratio of hydrogen peroxide to surfactant ranges from about 200:1 to about 10:1.

7. The method of claim 1, further comprising contacting a deposit in the cooling tower fill with the composition.

8. The method of claim 1, wherein the composition has a pH of about 0 to about 7.

9. The method of claim 1, wherein the composition contacts the cooling tower fill for about 1 minute to about 48 hours.

10. A method of cleaning cooling water systems, comprising:

contacting a deposit with a composition consisting of water and about 0.50% to about 50% by weight of hydrogen peroxide; and contacting the deposit with a surfactant, when the cooling water system is off-line.

11. The method of claim 10, wherein the hydrogen peroxide is present in an amount from about 7% to about 50% by weight.

12. The method of claim 10, wherein the hydrogen peroxide is present in an amount from about 30% to about 40% by weight.

13. The method of claim 10, wherein the surfactant is non-ionic, ionic, or zwitterionic.

14. The method of claim 10, wherein a mass ratio of hydrogen peroxide to surfactant ranges from about 200:1 to about 10:1.

15. The method of claim 7, wherein the deposit comprises silica.

16. The method of claim 7, wherein the deposit comprises silt.

17. The method of claim 10, wherein the composition contacts the deposit for about 1 minute to about 48 hours.

18. A method of cleaning a cooling water system, comprising:

contacting a cooling tower fill with a composition consisting of a surfactant, an oxidizing agent, water, and optionally, an acid, when the cooling water system is off-line, wherein:

the surfactant is selected from an alkyl aryl sulfonate, an olefin sulfonate, a paraffin sulfonate, an alcohol sulfate, an alcohol ether sulfate, an alkyl carboxylate, an alkyl ether carboxylate, an alkyl phosphate ester, an ethoxylated alkyl phosphate ester, a mono- or di-alkyl sulfosuccinate, a mono- or di-alkyl sulfosuccinamate, an alkyl trimethyl quaternary ammonium salt, an alkyl dimethyl benzyl quaternary ammonium salt, a dialkyl dimethyl quaternary ammonium salt, an imidazolinium salt, an alcohol alkoxylate, an alkylphenol alkoxylate, a block copolymer of ethylene, propylene or butylene oxide, an alkyl dimethyl amine oxide, an alkyl-bis(2-hydroxyethyl) amine oxide, an alkyl amidopropyl dimethyl amine oxide, an alkylamidopropyl-bis(2-hydroxyethyl) amine oxide, alkyl polyglucoside, polyalkoxylated glyceride, a sorbitan ester, a polyalkoxylated sorbitan ester, an alkoyl polyethylene glycol ester, an alkoyl polyethylene glycol diester, a betaine, a sultane, an alkyl amphoacetate, an alkyl amphodiacetate, an alkyl amphopropripionate, an alkyliminodiproprionate, a $C_6$-$C_{18}$ alkyl polyglycoside, or combinations thereof;

the oxidizing agent is selected from hydrogen peroxide, sodium hypochlorite, chlorine dioxide, ozone, sodium hypobromite, sodium or potassium permanganate, potassium peroxymono sulfate, peroxy salts of alkali earth metals, or any combination thereof;

the acid is selected from hydrochloric acid, sulfuric acid, sulfamic acid, or any combination thereof; and a concentration of the oxidizing agent in the composition is about 0.50% to about 50% by weight.

* * * * *